US011291089B2

(12) United States Patent
DeHope et al.

(10) Patent No.: US 11,291,089 B2
(45) Date of Patent: Mar. 29, 2022

(54) LED CONTROL METHOD FOR PERCEIVED MIXING

(71) Applicant: Robern, Inc., Bristol, PA (US)

(72) Inventors: James A. DeHope, Hatboro, PA (US); Donna J. Morgan, Ewing, NJ (US); Harshil N. Patel, Mount Laurel, NJ (US); James L. Stanley, Jr., Levittown, PA (US)

(73) Assignee: Robern, Inc.

( * ) Notice: Subject to any disclaimer, the term of this patent is extended or adjusted under 35 U.S.C. 154(b) by 0 days.

(21) Appl. No.: 16/910,462

(22) Filed: Jun. 24, 2020

(65) Prior Publication Data

US 2020/0329540 A1 Oct. 15, 2020

Related U.S. Application Data

(63) Continuation of application No. 16/412,806, filed on May 15, 2019, now Pat. No. 10,728,976.
(Continued)

(51) Int. Cl.
*H05B 45/20* (2020.01)

(52) U.S. Cl.
CPC ..... *H05B 45/20* (2020.01)

(58) Field of Classification Search
CPC ..... G09G 2310/0235; G09G 3/3413; H05B 31/50; H05B 33/08; H05B 45/10; H05B 45/20; H05B 45/22; H05B 45/24; H05B 45/31; H05B 45/37; H05B 45/3725; H05B 45/395; H05B 45/46; H05B 47/16; Y02B 20/30
See application file for complete search history.

(56) References Cited

U.S. PATENT DOCUMENTS 6,016,038 A 1/2000 Mueller et al.
6,340,868 B1 1/2002 Lys et al.
(Continued)

OTHER PUBLICATIONS

Dahl, Oyvind Nydal, "Blinking LED Circuit with Schematics and Explanation", https://www.build-electronic-circuits.com/author/oyvind/, Feb. 26, 2017, pp. 1-9.
(Continued)

*Primary Examiner* — Renan Luque
(74) *Attorney, Agent, or Firm* — The Belles Group, P.C.

(57) ABSTRACT

According to one embodiment, a lighting apparatus includes light sources, each light source emitting a different electromagnetic radiation having a different color temperature when turned ON. A controller turns ON and OFF each light source such that each electromagnetic radiation of each light source comprises a series of pulses. The controller alternate between turning ON each of the light sources with a speed sufficient to cause a perception of mixing the electromagnetic radiations of the light sources, thereby causing an appearance of a perceived light having a perceived color temperature different from the color temperatures of the light sources. To ensure that only one of the light sources is ON at a time, the controller waits a predetermined time between turning OFF a light source and turning ON a subsequent light source. The predetermined time is based on both a time for a light source of the plurality of light sources to turn OFF and a variable buffer time.

17 Claims, 11 Drawing Sheets

Related U.S. Application Data

(60) Provisional application No. 62/671,675, filed on May 15, 2018.

(56) References Cited

U.S. PATENT DOCUMENTS

| | | | | |
|---|---|---|---|---|
| 6,441,558 | B1 | 8/2002 | Muthu et al. | |
| 6,788,011 | B2 | 9/2004 | Mueller et al. | |
| 6,975,079 | B2 | 12/2005 | Lys et al. | |
| 7,014,336 | B1 | 3/2006 | Ducharme et al. | |
| 7,255,457 | B2 | 8/2007 | Ducharme et al. | |
| 7,274,160 | B2 | 9/2007 | Mueller et al. | |
| 7,317,403 | B2 | 1/2008 | Grootes et al. | |
| 7,350,936 | B2 | 4/2008 | Ducharme et al. | |
| 7,358,679 | B2 | 4/2008 | Lys et al. | |
| 7,520,634 | B2 | 4/2009 | Ducharme et al. | |
| 7,572,028 | B2 | 8/2009 | Mueller et al. | |
| 7,598,686 | B2 | 10/2009 | Lys et al. | |
| 7,703,943 | B2 | 4/2010 | Li et al. | |
| 7,959,320 | B2 | 6/2011 | Mueller et al. | |
| 7,967,652 | B2 | 6/2011 | Emerson | |
| 8,159,125 | B2 | 4/2012 | Miao | |
| 8,203,260 | B2 | 6/2012 | Li et al. | |
| 8,358,089 | B2 | 1/2013 | Hsia et al. | |
| 8,410,727 | B2 | 4/2013 | Mizuno | |
| 8,699,969 | B2 | 4/2014 | Wang et al. | |
| 8,723,443 | B2 | 5/2014 | Deurenberg et al. | |
| 8,729,823 | B2 | 5/2014 | Swamy et al. | |
| 8,736,197 | B2 | 5/2014 | Datta et al. | |
| 8,779,687 | B2 | 7/2014 | Harbers | |
| 8,783,887 | B2 | 7/2014 | Caruso et al. | |
| 8,796,952 | B2 | 8/2014 | Van de Ven | |
| 8,847,516 | B2 | 9/2014 | Chobot | |
| 8,853,964 | B2 | 10/2014 | Sutardja et al. | |
| 8,928,249 | B2 | 1/2015 | Raj et al. | |
| 8,957,602 | B2 | 2/2015 | Zhang et al. | |
| 9,107,257 | B2 | 8/2015 | Jayabalan et al. | |
| 9,192,008 | B2 | 11/2015 | Eckel et al. | |
| 9,198,251 | B2 | 11/2015 | Ter Weeme et al. | |
| 9,237,612 | B1 | 1/2016 | Lewis et al. | |
| 9,237,623 | B1 | 1/2016 | Lewis et al. | |
| 9,307,614 | B2 | 4/2016 | Chen et al. | |
| 9,425,896 | B2 | 8/2016 | Harbers et al. | |
| 9,468,069 | B2 | 10/2016 | Lee | |
| 9,538,603 | B2 | 1/2017 | Shearer et al. | |
| 9,544,968 | B2 | 1/2017 | Matsubayashi et al. | |
| 9,549,448 | B2 | 1/2017 | Pope et al. | |
| 9,560,713 | B2 | 1/2017 | Lee et al. | |
| 9,560,714 | B1 | 1/2017 | Hjerde | |
| 9,642,207 | B2 | 5/2017 | Cash | |
| 9,648,696 | B2 | 5/2017 | Weaver | |
| 9,713,211 | B2 | 7/2017 | van de Ven et al. | |
| 9,717,123 | B1 * | 7/2017 | Yao | H05B 45/10 |
| 9,795,000 | B1 | 10/2017 | Sooch et al. | |
| 10,728,976 | B2 * | 7/2020 | DeHope | H05B 45/20 |
| 2006/0239689 | A1 | 10/2006 | Ashdown | |
| 2010/0045195 | A1 | 2/2010 | Yamamuro | |
| 2010/0097002 | A1 * | 4/2010 | Shatford | H05B 45/22 315/210 |
| 2013/0020957 | A1 | 1/2013 | Forster | |
| 2015/0035441 | A1 | 2/2015 | Hasegawa | |
| 2015/0116379 | A1 * | 4/2015 | Lim | G09G 3/342 345/691 |
| 2015/0373790 | A1 | 12/2015 | Boswinkel | |
| 2016/0088697 | A1 * | 3/2016 | Yan | H05B 45/20 315/205 |
| 2016/0174317 | A1 | 6/2016 | Barnett | |
| 2016/0255687 | A1 * | 9/2016 | Zhang | H05B 45/20 315/210 |
| 2017/0168212 | A1 | 6/2017 | Chen | |
| 2018/0255619 | A1 | 9/2018 | Kido | |

OTHER PUBLICATIONS

Strange, Maxwell, "Clip extracts signal from phone line", www.edn.com, Jul. 24, 2003, pp. 1-6.

ELEC Circuit, "LED Flashers Circuits and Projects using Transistor", https://www.elecircuit.com/blog/, Blog comments from 2008-2018, pp. 1-18.

* cited by examiner

LED CONTROL METHOD FOR PERCEIVED MIXING

CROSS-REFERENCE TO RELATED PATENT APPLICATIONS

The present application is a continuation of U.S. patent application Ser. No. 16/412,806, filed May 15, 2019, which claims the benefit of U.S. Provisional Patent Application Ser. No. 62/671,675, filed May 15, 2018. The disclosures of these references are incorporated herein by reference in their entireties

BACKGROUND

Light emitting diodes (LEDs) are widely available due to their relative power savings as compared to traditional incandescent lamps. Light from LEDs is produced due to the physical properties of a semiconducting material. For example, when a voltage is applied across a semiconductor junction that has different levels of electron doping across the boundary, an electric current is induced. When an electron from one side of the device recombines with an electron hole on the other, a photon is emitted. Depending on the semiconductor design, the photons may be emitted at various frequencies/wavelengths within the visible light spectrum. The frequencies/wavelengths within the visible light spectrum affect color attributes of the emitted light. For example, emitted light appears redder as the wavelength of the emitted light increases and the frequency decreases. Conversely, emitted light becomes bluer as the wavelength of the emitted light decreases and the frequency increases.

Methods are known for combining colors of two or more LEDs to generate a composite color. Conventional methods may be inefficient, however, as multiple LEDs are concurrently used to generate a single (composite) color. Therefore, there is need for a method of generating a single (composite) color wherein the first LED and the second LED do not concurrently emit light.

BRIEF SUMMARY

The invention may be directed to a system comprising a lighting apparatus. The lighting apparatus may include light sources. Each light source may emit a different electromagnetic radiation having a different color temperature when turned ON. The lighting apparatus may include a voltage source providing power to the light sources and a controller. The controller may turn ON and OFF each light source such that each electromagnetic radiation of each light source comprises a series of pulses. The controller may alternate between turning ON each of the light sources with a speed sufficient to cause a perception of mixing the electromagnetic radiations of the light sources, thereby causing an appearance of a perceived light having a perceived color temperature different from the color temperatures of the light sources. To ensure that only one of the light sources is ON at a time, the controller may wait a predetermined time between turning OFF a light source and turning ON a subsequent light source.

In one aspect, a lighting apparatus includes light sources, each light source configured to emit a different electromagnetic radiation having a different color temperature when turned ON; a voltage source providing power to the light sources; a controller configured to turn ON and OFF each light source such that each electromagnetic radiation of each light source comprises a series of pulses; and alternate between turning ON each of the light sources with a speed sufficient to cause a perception of mixing the electromagnetic radiations of the light sources, and thereby cause an appearance of a perceived light having a perceived color temperature different from the color temperatures of the light sources; wherein to ensure that only one of the light sources is ON at a time, the controller waits a predetermined time between turning OFF a light source and turning ON a subsequent light source.

In another aspect, a method includes providing power to light sources, each light source configured to emit a different electromagnetic radiation having a different color temperature when turned ON; and alternating between turning ON each of the light sources with a speed sufficient to cause a perception of mixing the electromagnetic radiations of the light sources, and thereby cause an appearance of a perceived light having a perceived color temperature different from the color temperatures of the light sources; wherein each light source is turned ON and OFF such that each electromagnetic radiation of each light source comprises a series of pulses; and wherein, to ensure that only one of the light sources is ON at a time, a predetermined time is waited between turning OFF a light source and turning ON a subsequent light source.

In another aspect, a non-transitory computer-readable storage medium is encoded with instructions which, when executed on a processor, perform a method of turning ON and OFF light sources, each light source configured to emit a different electromagnetic radiation having a different color temperature when turned ON, and each electromagnetic radiation of each light source comprising a series of pulses; and alternating between turning ON each of the light sources with a speed sufficient to cause a perception of mixing the electromagnetic radiations of the light sources, and thereby cause an appearance of a perceived light having a perceived color temperature different from the color temperatures of the light sources; wherein, to ensure that only one of the light sources is ON at a time, a predetermined time is waited between turning OFF a light source and turning ON a subsequent light source.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
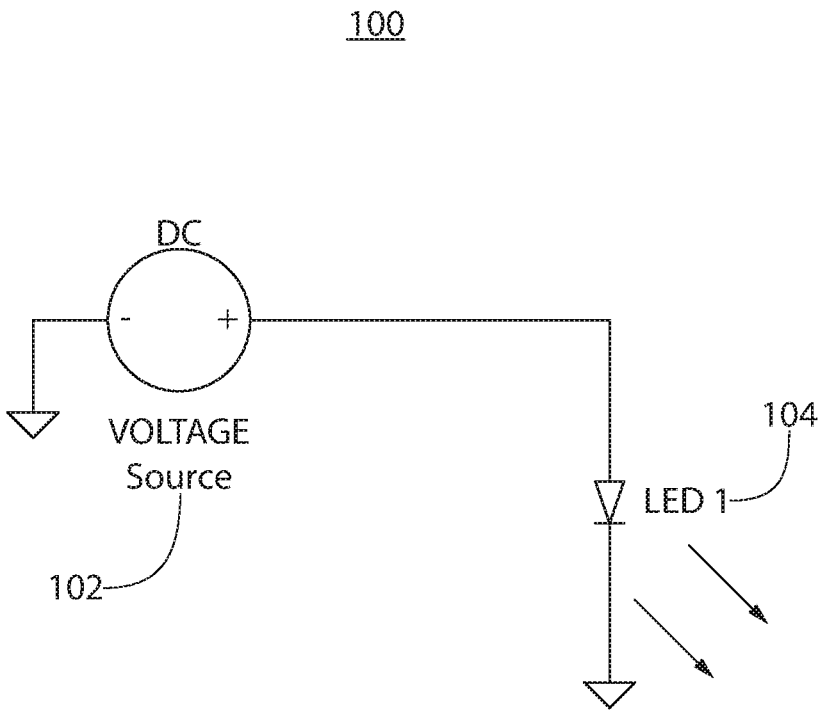
FIG. 1 is an example circuit for providing a voltage to one or more light emitting diodes (LEDs), as described herein.

The following description of the preferred embodiment(s) is merely exemplary in nature and is in no way intended to limit the invention, its application, or uses. The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Systems and methods described herein relate to light emitted from a lighting apparatus. The lighting apparatus may comprise one or more light sources, as described herein. The light sources may be configured to emit an electromagnetic radiation having a color temperature when the light sources are turned ON. Each light source may be configured to emit a different electromagnetic radiation having a different color temperature than one or more other light sources. An example light source may be a light emitting diode (LED).

The various systems and methods described herein may make reference to determining, changing, or varying the color temperature of a light source, such as the color temperature emitted by an LED. The electromagnetic radiation of two or more light sources may be shared, for example, within a lighting apparatus housing the two or more light sources. In sharing the electromagnetic radiation of the two or more light sources, the color temperatures of the two or more light sources may be shared (e.g., combined, mixed, etc.).

A color temperature may be said to be warm (e.g., red), cool (e.g., blue), or a color temperature somewhere between warm and cool. As it relates to color temperature, an LED may be said to become redder, an LED may be said to appear redder, an LED may be said to shift light towards red, warming the light, and/or otherwise shifting the light to a higher wavelength/lower frequency. Such terms may refer to the process of changing the composite color temperature of an LED to a lower color temperature. Similarly, as it relates to color temperature, an LED may be said to become bluer, making a light source appear bluer, shifting light towards blue, cooling the light, and/or otherwise shifting the light to a lower wavelength/higher frequency. Such terms may refer to the process of changing the composite color temperature of an LED to a higher color temperature.

As further described herein, two or more light sources (e.g., LEDs) may be controlled to vary the color temperature of a perceived light (e.g., composite light) emitted from the two or more LEDs. When used herein, the term composite light emitted from two or more LEDs may refer to the mixed or joint emissions of light as seen from an observer at a distance away from the light source. For example, the LEDs may be included in a single light fixture, and to an observer the composite light emitted by the two or more LEDs may appear to be from as a single LED. In another example, although a first LED may be included in a different light fixture than a second LED, the two light sources may be located sufficiently close together (e.g., from the perspective of an observer) that their composite emissions may appear to be from a single light source. As may be appreciated, the relative proximity of two or more LEDs that emit composite or combined light emissions may vary depending on the position or distance of a desired target or observer of the composite light emissions. For example, the two or more light sources may be located relatively close together (e.g., in the same fixture) if the target or observer of the composite light is relatively close to the light sources. However, if the target or observer is farther away, the two or more light sources may be separated by a greater distance.

Although the composite light may be the combined emissions of two or more LEDs, in other examples one or more LEDs may be used in combination with one or more other light sources, such as an incandescent or halogen lamp. The composite light may include the light emitted from the incandescent or halogen lamp and the one or more LEDs. Various combinations of LEDs and other than LED light sources may be utilized.

Two or more LEDs may emit (e.g., may each emit) electromagnetic radiation having a color temperature. The color temperature from one of the LEDs may be different than one or more of the color temperatures of one or more of the other LEDs. The electromagnetic radiations having the color temperatures (e.g., different color temperatures) may be combined/shared/mixed. The combined/shared/mixed color temperatures may be perceived as a single (e.g., composite) color temperature. The source of the colors may be referred to as a color source, a lighting apparatus, a light fixture, etc. The color source may include a single LED, or the color source may be multiple LEDS connected together and/or working in unison to provide illumination.

As described herein, the color temperature emitted by one or more LEDs may be different than the color temperature emitted by one or more other LEDs. As described herein, two or more LEDs (e.g., two or more LEDs emitting different color temperatures) may be used to create a combined/mixed color temperature in a viewer's perception of view. Although two or more LEDs may be used to create a mixed color, the two or more LEDs may emit light (e.g., with color temperatures) at different times. For example, embodiments provided herein describe an (e.g., one) LED emitting light, such as one (e.g., only one) LED emitting light at a time. Such emission of light from the LED may be referred to as a pulse. For example, a first LED may be in an ON state and may emit light (with a color temperature) while a second LED may be in an OFF state and refrain from emitting light. After the first LED goes to an OFF state and stops emitting light, the second LED may go to an ON state and may begin emitting light (with a color temperature). Upon an LED (e.g., first LED) going from an ON state to an OFF state, other LEDs (e.g., the second LED) may wait a predetermined time (e.g., a buffer time) before going to an ON state and emitting light, as described herein.

Although the first LED and the second LED may emit light at different (e.g., non-overlapping) times, the colors (e.g., different colors) emitted from the first LED and the second LED may be mixed/combined in the perception of a person. For example, while viewing the light an observer may be unable to perceive that the first LED and the second LED do not emit light at the same time. Pulsing (e.g., independent pulsing, or flashing) of the illumination and/or color temperatures may be performed in such a fashion that, through the principal of persistence of vision (POV), two or more color temperatures may appear mixed/combined. Such mixed/combined color temperatures may be perceived as a new color temperature. The mixed/combined color temperatures may be perceived as a new color temperature, as persistence of vision provides for the continuity (e.g., apparent continuity) of rapidly presented discrete images. POV may consist of a brief retinal persistence of one image so that the one image may be overlapped by the next image. As a result of POV, the images may be interpreted as continuous.

Embodiments of the invention may be described in terms of a constant voltage circuit, a variable voltage, a constant current, and/or a variable current. As an example, in a constant voltage a circuit may be designed and/or stated to work with constant voltage power supplies. The accompanying circuits may be designed to control the presence or absence of the voltage output. In a variable voltage, a circuit may work with variable voltage output supplies. The accompanying circuits may control the amount of voltage produced by the power supply. In a constant current, a circuit may be designed and/or stated to work with constant current power supplies. The accompanying circuits may be designed to control the presence or absence of the current output. In a variable current, a circuit may be designed and/or stated to work with variable current output supplies. The accompanying circuits control the amount of current produced by the power supply.

Embodiments of the invention may use and/or refer to pulse length modulation, flicker fusion threshold/flicker fusion rate/critical flicker frequency, and/or Talbot-Plateau Law. Pulse length modulation may be a modulation of a radio wave or signal in which the intelligence is conveyed by varying the length or duration of the pulses of the wave. Flicker fusion threshold/flicker fusion rate/critical flicker frequency may be the frequency at which an intermittent light stimulus appears to be completely steady to the average human observer. Talbot-Plateau Law may be the brightness of a fused temporally modulated stimulus (e.g., a pulsed light that is above the flicker fusion threshold). Talbot-Plateau Law may be equal to the brightness of a steady light of the same average luminance. For example, $T_B=L_{MIN}+(L_{MAX}-L_{MIN})*F$, where: $T_B$=Talbot Brightness; $L_{MAX}$=Luminance at maximum amplitude; $L_{MIN}$=Luminance at minimum amplitude; and/or F=Fraction of time that $L_{MAX}$ is ON during the total period.

Referring to the figures, FIG. 1 shows an example circuit 100 providing a voltage via a voltage source 102. The voltage may be provided to one or more loads, such as one or more lighting apparatuses, LEDs 104, color sources, light fixtures, etc. A lighting apparatus may include one or more LEDs, an LED array, etc. The LED may emit an electromagnetic radiation having a color temperature. The lighting apparatus may combine/mix the color temperatures of one or more LEDs and may emit a (e.g., a composite) color temperature that is different than one or more of the color temperatures of the one or more LEDs. For example, each of the LEDs may emit a (e.g., a different) color temperature. The different color temperatures of the LEDs may be mixed, for example, within the lighting apparatus when the voltage source 102 provides power to the lighting apparatus. The mixed color temperature will be a composite color temperature.

Figure 2:
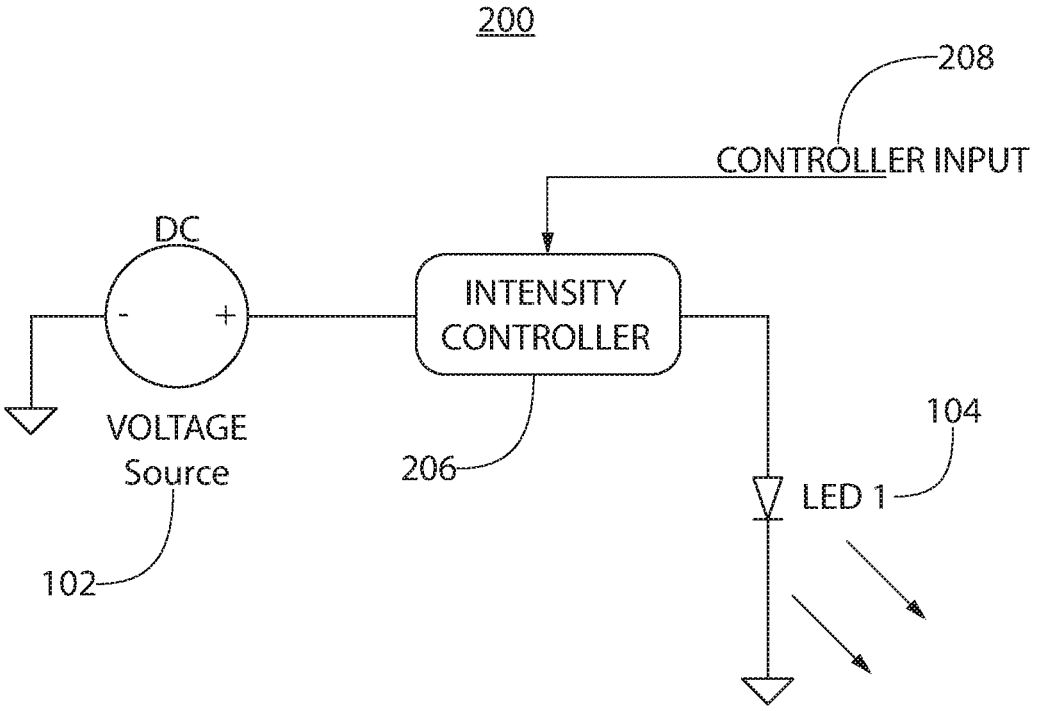
FIG. 2 is an example circuit for providing a voltage to one or more LEDs using an intensity controller, as described herein.

FIG. 2 shows an example circuit 200 including an intensity controller 206 for controlling the intensity of light emitted from a lighting apparatus (e.g., LEDs within a lighting apparatus). Voltage source 102 provides a voltage to one or more lighting apparatuses, LEDs, LED arrays, etc., as described herein. Intensity controller 206 may be configured to modify the intensity of the voltage provided to the lighting apparatus and/or LED. For example, the illumination of the LED may be decreased if the intensity of the voltage is decreased or the illumination of the LED may be increased if the intensity of the voltage is increased.

The intensity controller 206 may receive one or more signals, such as controller input 208, that may be used to determine whether the intensity of the lighting apparatus, LED, and/or LED array is to be decreased, increased, or unchanged. The signals may be provided to the intensity controller 206 manually (e.g., via a switch actuated by a user) or automatically. Although FIG. 2 shows the intensity controller as a single controller positioned between voltage source 102 and LED 104, is should be understood that the number, configuration, location of the intensity controller 206 shown in FIG. 2 is for illustration purposes only and is nonlimiting.

Figure 3:
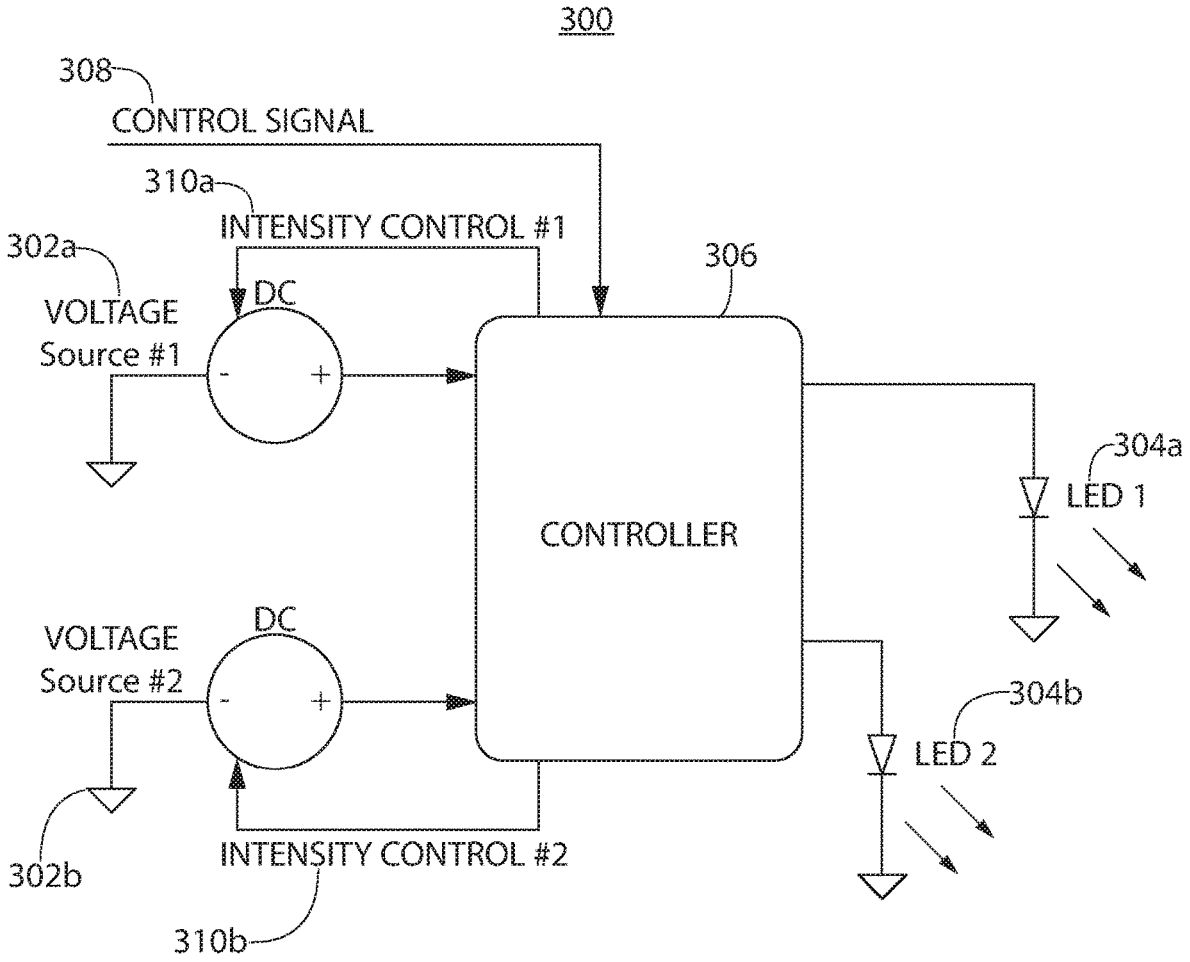
FIG. 3 is an example circuit for providing a voltage to one or more LEDs via more than one voltage source, as described herein.

FIG. 3 shows an example circuit 300 used for adjusting the intensity of light provided by two or more LEDs, such as first LED 304*a* and second LED 304*b*. As shown in FIG. 3, the LEDs are powered (e.g., individually powered) by voltage sources. For example, first LED 304*a* is powered by first voltage source 302*a* and second LED 304*b* is powered by second voltage source 302*b*. In other examples, the LEDs may share a power source, the power sources may provide power via a rotation, the power sources may be used as a backup power source, etc.

The intensity of first LED 304*a* and/or second LED 304*b* may be adjusted. For example, controller 306 may be configured to adjust the intensity of first LED 304*a* and/or second LED 304*b*. Controller 306 may provide a signal to first voltage source 302*a* and/or second voltage source 302*b* to adjust the output voltage provided to first LED 304*a* and/or second LED 304*b*. By adjusting the output voltage provided to first LED 304*a* and/or second LED 304*b*, the intensity (e.g., brightness) of the LEDs may be adjusted. Adjusting the intensity (e.g., brightness) of the LEDs may control (e.g., independently control) the illumination of one or more of the LEDs. The controller 306 may receive one or more signals, such as control signal 308, that may be used to determine whether the intensity of the lighting apparatus, LED, and/or LED array is to be adjusted (e.g., decreased, increased, or unchanged).

As shown in FIG. 3, circuit 300 may utilize two or more circuits. For example, circuit 300 may include a first intensity controller circuit 310*a* and a second intensity controller circuit 310*b*. The individual intensity of the LED (and/or the color temperature of the LED) may be controlled by the intensity control signal of the specific circuit. For example, first intensity controller circuit 310*a* may control the intensity emitted by first LED 304*a* and second intensity controller circuit 310*b* may control the intensity emitted by second LED 304*b*.

The overall (e.g., maximum) intensity of the LED may be controlled (e.g., limited) by a voltage source. For example, first voltage source 302*a* may control (e.g., limit) the overall (e.g., maximum) intensity of first LED 304*a* and second voltage source 302*b* may control (e.g., limit) the overall (e.g., maximum) intensity of second LED 304*b*, although, as described herein, the illumination of an (e.g., each) LED may be controlled by controller 306. Controller 306 may receive a signal, such as control signal 308, to control the intensity of one or more of the LEDs. The signal may be provided to the controller 306 manually (e.g., via a switch actuated by a user) or automatically.

Figure 4:
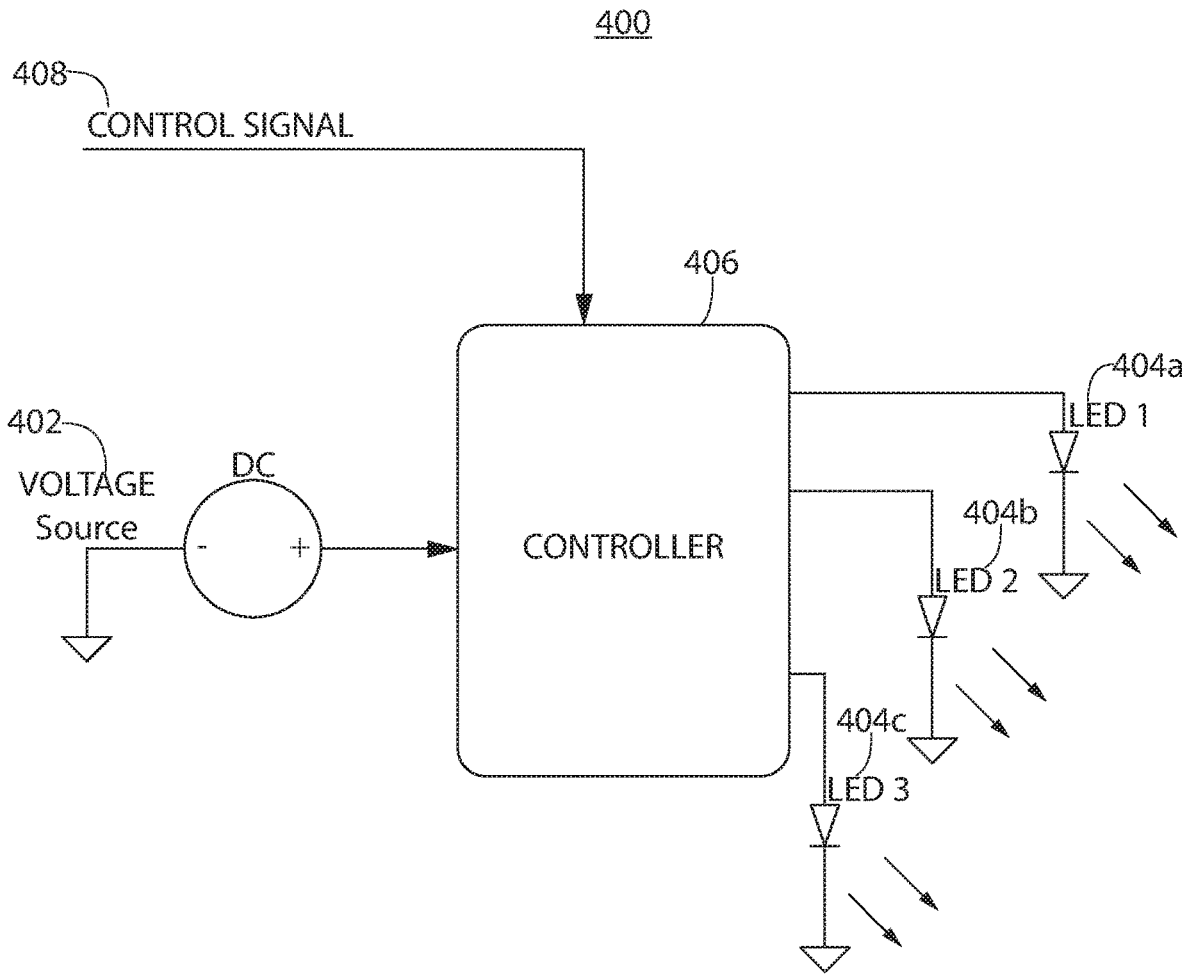
FIG. 4 is another example circuit for providing a voltage to one or more LEDs, as described herein.

FIG. 4 shows an example circuit 400 used for mixing the color provided by two or more LEDs, such as first LED 404*a*, second LED 404*b*, and third LED 404*c*. Although FIG. 4 shows LEDs powered by a single power source (e.g., voltage source 402), such illustration is for example only and one or more power sources may be used to power the LEDs. Controller 406 may perform similarly to controller 306, as described herein. For example, controller 406 may control (e.g., independently control) the illumination of first LED 404*a*, second LED 404*b*, and/or third LED 404*c*. For example, controller 406 may control (e.g., independently control) the brightness of first LED 404*a*, second LED 404*b*, and/or third LED 404*c*. Controller 406 may receive a signal, such as control signal 408, to control the intensity of one or more of the LEDs. The signals may be provided to the controller 406 manually (e.g., via a switch actuated by a user) or automatically. Circuit 400 may include a single circuit from voltage source 402 to controller 406, for example. In other examples circuit 400 may use more than one circuit, such as the intensity controller circuits described in FIG. 3.

As described herein, intensities (e.g., individual intensities) of the LEDs may be controlled by a controller, such as controller 406. For example, intensities of the first LED 404*a*, second LED 404*b*, and/or third LED 404*c* may be controlled by controller 406. Adjusting the intensities of one or more of the LEDs may adjust the color temperature (e.g., composite color) provided by the one or more LEDs, lighting fixtures, etc. For example, by adjusting the intensity of first LED 404*a*, the color temperature (e.g., composite color temperature) emitted by a lighting fixture housing first LED 404*a*, second LED 404*b*, and third LED 404*c* may be adjusted (e.g., the color temperature may be made redder, bluer, etc.).

The overall (e.g., maximum) intensity of the LED may be controlled by the voltage source 402. For example, voltage source 402 may control the overall (e.g., maximum) intensity of first LED 404*a*, second voltage source 402*b*, and/or third voltage source 402*c*. The illumination of an (e.g., each) LED may be controlled by controller 406. Controller 406 may receive a signal, such as control signal 408, to control the intensity of one or more of the LEDs. The signals may be provided to the controller 406 manually (e.g., via a switch actuated by a user) or automatically.

The intensity or illumination time of an LED may be adjusted (e.g., reduced, increased). By adjusting (e.g., reducing, increasing) the intensity or illumination time of an LED color relative to one or more other LEDs in the circuit, the perceived blended color (e.g., composite color) output may change. For example, if the intensity or illumination time of first LED 404*a* is reduced relative to second LED 404*b* and/or third LED 404*c*, the perceived blended color output (e.g., the perceived blended color output of the first LED 404*a*, second LED 404*b*, and/or third LED 404*c*) may change.

As an example, first LED 404*a* may emit a warm (e.g., reddish) color and second LED 404*b* may emit a cool (e.g., bluish) color. If the intensity or illumination time of the first LED 404*a* is reduced, the light emitted (e.g., composite light emitted) may be perceived by a viewer to be bluer (e.g., cooler) than before the intensity or illumination time of the first LED 404*a* was reduced. The light emitted (e.g., composite light emitted) may be perceived by a viewer to be bluer (e.g., cooler) because the intensity of the LED emitting the redder color temperature has decreased. As another example, first LED 404*a* may emit a warm (e.g., reddish) color and second LED 404*b* may emit a cool (e.g., bluish) color. If the intensity or illumination time of the second LED 404*b* is reduced, the light emitted (e.g., composite light emitted) may be perceived by a viewer to be warmer than before the intensity or illumination time of the second LED 404*b* was reduced. The light emitted (e.g., composite light emitted) may be perceived by a viewer to be redder (e.g., warmer) because the intensity of the LED emitting the bluer color temperature has decreased. Although the examples describe an intensity or illumination time being reduced, this is for example purposes only. Other examples may include the intensity or illumination time being increase, unchanged, etc.

In examples, among a plurality of LEDS, one LED (e.g., only one LED) may illuminate at a time. The one LED illuminating may result in one (e.g., only one) LED emitting light and/or may result in one (e.g., only one) color being emitted by the LED. In examples controller 406 may be configured to ensure that one (e.g., only one) LED is illuminating at a time. For example, controller 406 may be configured to ensure that one (e.g., only one) LED circuit is in the ON state and illuminating at one time.

In examples, the controller 406 may switch from one circuit to another circuit. The switching (e.g., sequence/order of the switching) may occur in one or more (e.g., any) combinations. The sequence/order of the switching (e.g., of the same LEDs) may not affect the color temperature (e.g., composite color temperature). As an example, the controller 406 may switch from the circuit for the first LED 404*a* to the circuit for the second LED 404*b*, or the controller 406 may switch from the circuit for the second LED 404*b* to the circuit for the first LED 404*a*, without affecting the color temperature. The controller 406 may switch from the circuit for the first LED 404*a* to the circuit for the second LED 404*b* to the circuit for the third LED 404*c*, or the controller 406 may switch from the circuit for the third LED 404*c* to the circuit for the second LED 404*b* to the circuit for the first LED 404*a*, for example, without affecting the composite color temperature. As another example, the controller 406 may switch from the circuit for the first LED 404*a* to the circuit for the second LED 404*b*, the controller 406 may switch from the circuit for the second LED 404*b* to the circuit for the third LED 404*c*, the controller 406 may switch from the circuit for the third LED 404*c* to the circuit for the first LED 404*a*, etc.

When switching to a circuit, the LED associated with the circuit may go to an ON state. The controller 406 may be configured to switch from one or more circuits at a predefined frequency rate, such as every 5 ms, 10 ms, etc. The predefined frequency rate may be determined so that a viewer looking at the emitted light (e.g., emitted composite light) perceives the resultant combined/mixed color. The viewer looking at the emitted light (e.g., emitted composite light) may perceive the resultant combined/mixed color due to persistence of vision, as the synchronized light output may mix the light in the perception, eye, and/or mind of the viewer.

As described herein, circuits associated with two or more LEDs may be synchronized so that a viewer looking at the light (e.g., composite light) emitted by the two or more LEDs perceive the resultant combined/mixed color. FIGS. 5-10 show examples waveforms in which one or more circuits are synchronized. As described herein, the circuits may be synchronized to mix color temperature of two or more LEDs, for example, to provide a composite light.

Figure 5:
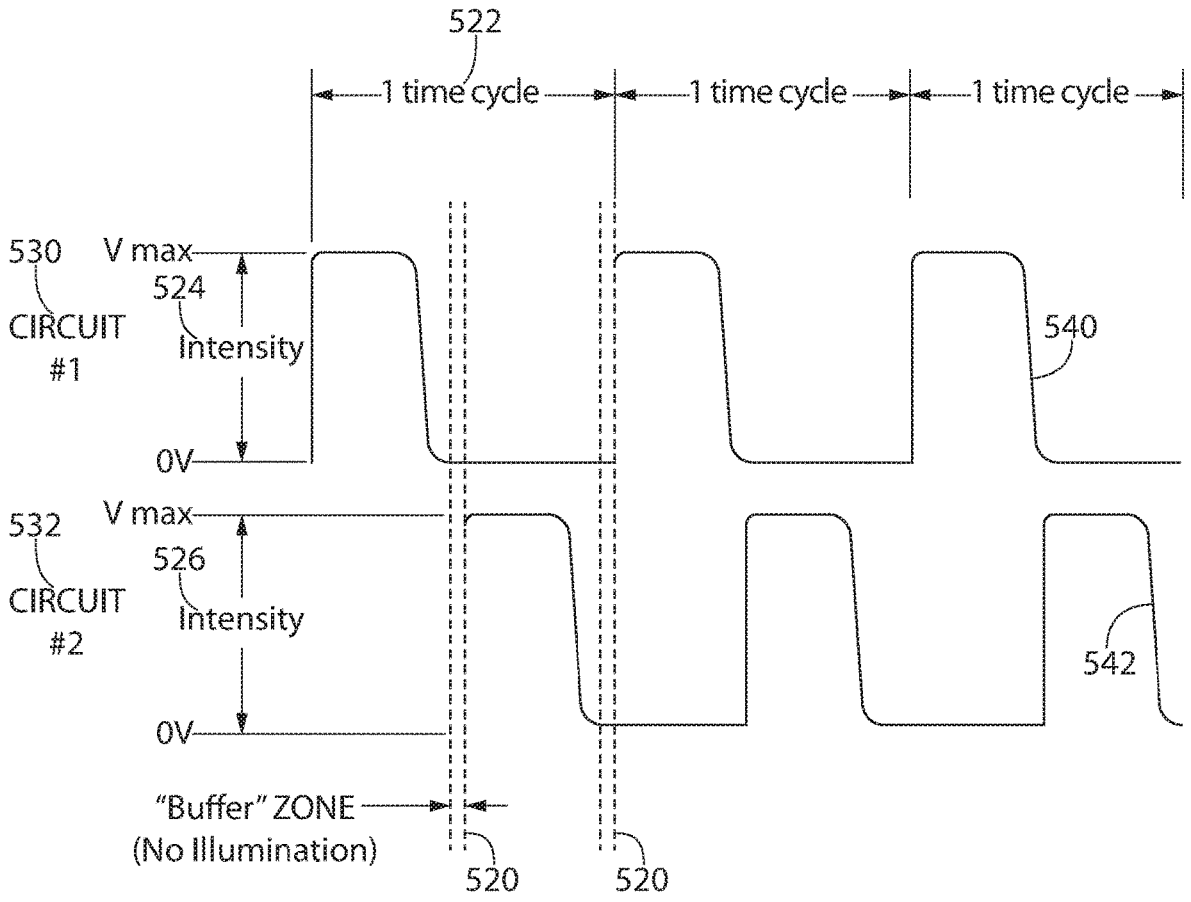
FIGS. 5-10 are example waveforms for color mixing, as described herein.

FIG. 5 shows example waveforms, such as waveforms 540, 542. Waveform 540 relates to first circuit 530 and waveform 542 relates to second circuit 532. The waveforms may be associated with a time cycle, such as time cycle 522. Each of the waveforms may be associated with an intensity. For example, waveform 540 may be associated with intensity 524 and waveform 542 may be associated with intensity 526. The waveforms may be associated with a maximum intensity, which may be the maximum voltage provided by the voltage source (such as voltage source 102). The waveforms may be associated with a minimum intensity, which may be a zero voltage. First circuit 530 and second circuit 532 may be at full intensity when illuminated or a fraction of full intensity when illuminated.

As shown in FIG. 5, when waveform 540 is illuminated (e.g., fully illuminated) waveform 542 is not illuminated (e.g., fully not illuminated). Said another way, when first circuit 530 is ON, second circuit 532 is OFF. Conversely, when waveform 540 is not illuminated (e.g., fully not illuminated) waveform 542 is illuminated (e.g., fully illuminated). Thus, when first circuit 530 is OFF, second circuit 532 is ON. As an LED (e.g., one LED) may have an association with a circuit, when a first LED is ON, a second LED is OFF, and vice-versa. Thus, when a first LED is illuminating and emitting a color temperature, a second LED is not illuminating and not providing a color temperature, and vice-versa.

A buffer may be provided. For example, buffer 520 may be provided to ensure that LEDs do not illuminate at the same time. For example, a first LED may be ON and a second LED may be OFF. In such an example, buffer 520 may be provided to ensure that the second LED does not illuminate (e.g., does not go to an ON state) until first LED is finished illuminating (e.g., goes to an OFF state). The time of the buffer may be predetermined. For example, the buffer time may a constant. In other examples the buffer time may be dynamically determined. For example, the time of the buffer may be based on conditions that may affect the combination/mixing of the color temperatures. As an example, a time of day may affect how well the color temperatures may combine. The buffer time may be modified (e.g., dynamically modified) based on the time of day. The buffer time may also be modified based on the weather, the location (e.g., inside or outside) of the lighting apparatus, etc. The buffer time may begin at different times and/or based on different actions. For example, the buffer time may begin when an LED is completely OFF, such as 520 in FIG. 5. In other examples the buffer time may begin when the LED turns ON, begins to turn OFF, begins to turn ON, etc. During the buffer time, illumination may not be provided by one or more of the LEDs.

Figure 6:
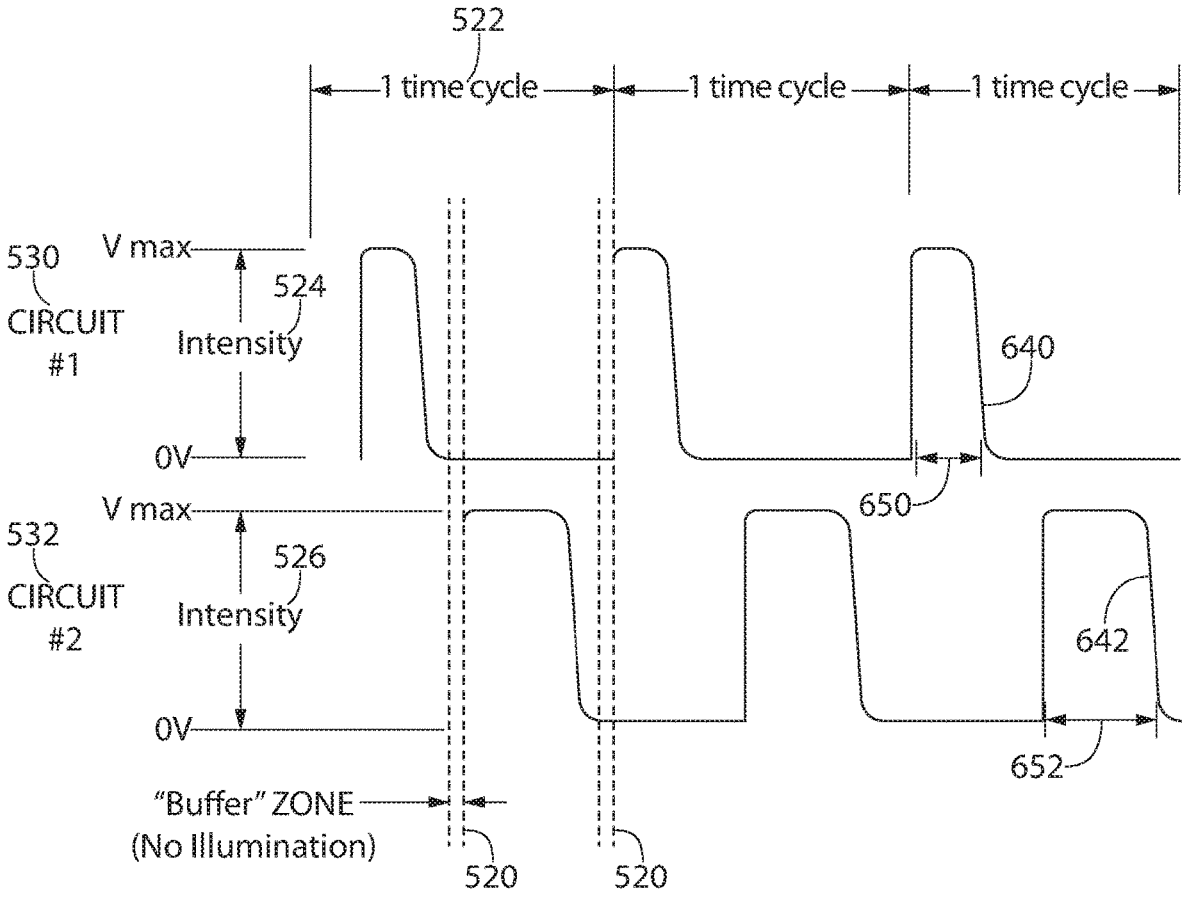

FIG. 6 shows example waveforms, such as example waveforms 640, 642. FIG. 6 further shows circuits 530, 532, intensities 524, 526, buffer 520, time cycle 522, as described in reference to FIG. 5. As shown in FIG. 5, waveforms 540 and 542 had similar (e.g., the same) intensities. For example, waveform 540 and waveform 542 would result in associated LEDs emitting light at full intensity when in the ON state. And, as shown in FIG. 5, waveform 540 and waveform 542 would result in associated LEDs emitting light for a similar (e.g., the same) amount of time when in the ON state.

FIG. 6 shows an example wherein the waveforms are at full intensity for different amounts of times (e.g., pulse lengths). The pulse length may be the amount of time (e.g., within a time cycle, such as time cycle 522) that the LED is ON and emits light.

FIG. 6 shows an example where the pulse length of waveform 640 is less than the pulse length of waveform 642. For example, waveform 640 has a pulse length of 650 and waveform 642 has a pulse length of 652. Although FIG. 6 shows pulse length 650 being one half of pulse length 652, a pulse length of a waveform may be any portion of a pulse length of another waveform, such as a third of a pulse length of another waveform, three fourths of a pulse length of another waveform, a fourth of a pulse length of another waveform, etc. An LED associated with a waveform having a larger pulse length than another LED may emit light that is brighter (e.g., more prevalent) than the LED associated with the smaller pulse length. For example, as the pulse length of first circuit 530 is less than the pulse length of second circuit 532, the LED (e.g., the color temperature of the LED) associated with the second circuit 532 may be brighter and more prevalent than the LED (e.g., the color temperature of the LED) associated with the first circuit 530.

Further, as described herein and shown in FIG. 6, in a time cycle (e.g., in every time cycle), when one circuit is at Vmax (the LED is ON, for example, at full intensity), the other circuit may be Vmin. The LED may be OFF at Vmin. For example, 0V may be provided at Vmin. In other examples, however, Vmin may be a nonzero number. Said another way and as shown in FIG. 6, at no point will more than one LED be illuminated. As a result, at no point will more than one LED emit a color temperature.

Figure 7:
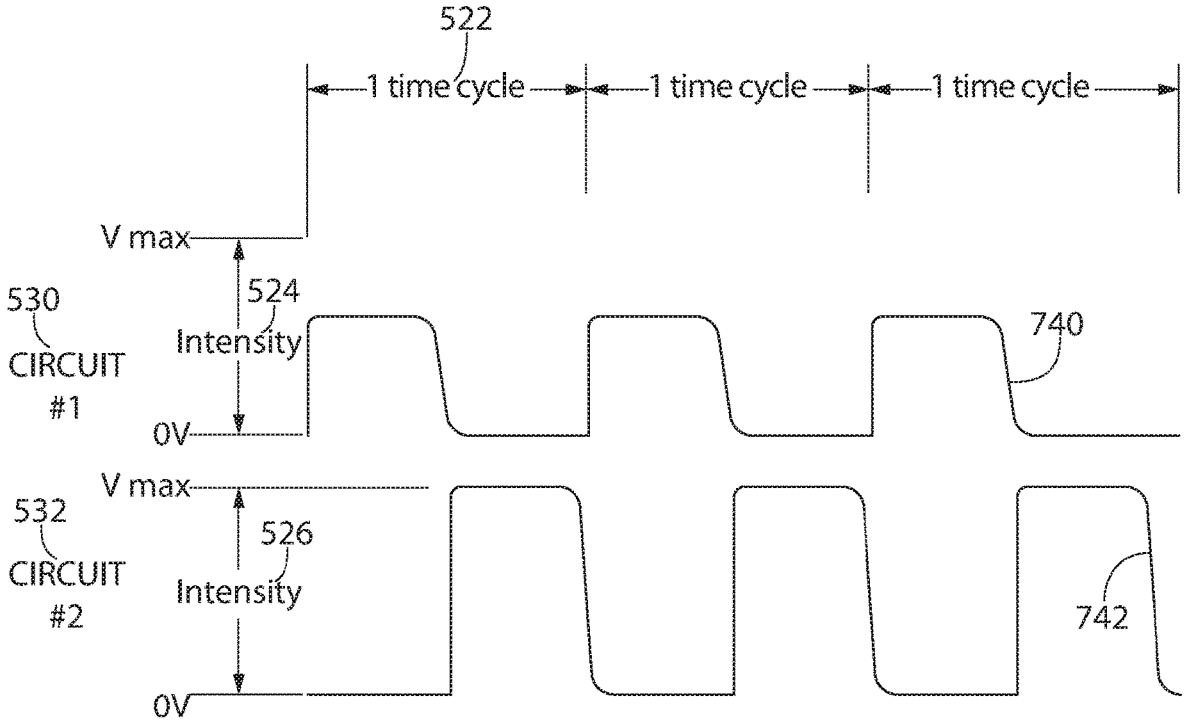

FIG. 7 shows an example in which the intensity of one waveform is a portion of (e.g., less than) the intensity of another waveform. For example, waveform 740 has an intensity that is less than Vmax (less than a full intensity) and a minimum intensity that is Vmin (LED is off). Less than Vmax may be any percentage less than Vmax, including 50% of Vmax, 25% of Vmax, 33% of Vmax, etc. Waveform 742 has an intensity that goes from Vmax (full intensity) to Vmin (LED is off). As a result, the intensity of the LED associated with the first circuit 530 (relating to waveform 740) is less than the intensity of the LED associated with the second circuit 532 (relating to waveform 742). Because the intensity of the LED associated with the first circuit 530 (relating to waveform 740) is less than the intensity of the LED associated with the second circuit 532 (relating to waveform 742), the LED associated with second circuit 532 (relating to waveform 742) is brighter and/or more prevalent than the LED associated with the first circuit 530 (relating to waveform 740). Further, as shown in FIG. 7, at no point will more than one LED (e.g., LED colors) be illuminated, as the intensity of one waveform is at Vmin when the other waveform is above Vmin.

As understood by those of skill in the art, the example waveforms shown in FIG. 7 may accomplish similar (e.g., the same) results as the example waveforms shown in FIG. 6. For example, the differing waveforms of FIG. 7 may affect the intensities of LEDs similar to how the differing waveforms of FIG. 6 may affect the intensities of LEDs. A difference between the examples shown in FIGS. 6 and 7 may be that the examples shown in FIG. 7 may reduce the voltage provided to first circuit 530, for example, to reduce the LED brightness. However, the examples shown in FIG. 6 may reduce the pulse time (e.g., duty cycle) of first circuit 530 to reduce the LED brightness. Further, although the two examples are provided to show how the intensity of one or more LEDs may be adjusted, it should be understood that the examples are for illustration only and other methods may exist to adjust the intensity of one or more LEDs. For example, although FIG. 6 shows waveforms of different pulse lengths and FIG. 7 shows waveforms of different intensities, it should be understood that any combination of pulse lengths and intensities may be used to adjust the intensities (e.g., brightness) of LEDs, etc.

Figure 8:
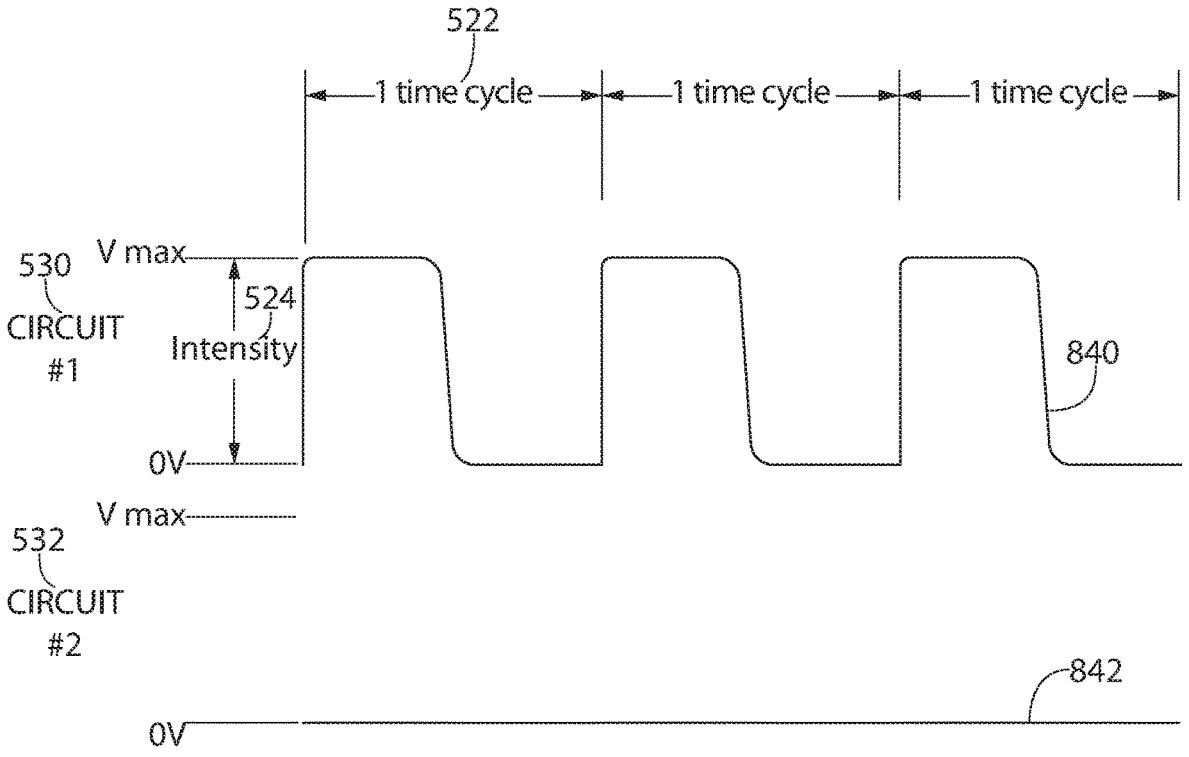

FIG. 8 shows another example in which the intensities of waveforms may differ, for example, to adjust the intensities of LEDs associated with the waveforms. As shown in FIG. 8, first circuit 530 has a waveform 840 that goes from Vmax (in which the LED is ON at full intensity) to Vmin (in which the LED is off). Second circuit 532 has a waveform 842 that remains at Vmin (in which the LED is off). As the second circuit 532 has a waveform 842 that remains at Vmin, the LED associated with the second circuit 532 will not emit a light and will not emit a color temperature. Further, as the second circuit 532 has a waveform 842 that remains at Vmin, at no point will both LED colors (colors from LEDs associated with circuits 530, 532) be illuminated.

As described above, waveform 840 goes from Vmax to Vmin. As a result, for a portion of time cycle 522, the LED associated with waveform 840 will not be illuminating. For example, the LED associated with waveform 840 may (e.g., may only) illuminate for half of a time cycle 522, a third of a time cycle 522, etc. When the LED associated with waveform 840 is not illuminating (e.g., when waveform does not have an intensity at Vmax), the LED associated with waveform 840 will not be illuminating nor will the LED associated with waveform 842 be illuminating. For example, if waveform 840 is at Vmax for half of a time cycle 522, illumination will be provided (e.g., only be provided) half of the time, for example, via the LED associated with waveform 840. And when the LED associated with waveform 840 is not illuminating, no LEDs will be illuminating, including the LED associated with waveform 842. As a result, the color temperature (e.g., only the color temperature) emitted by the LED associated with waveform 840 will be perceived by a viewer.

Figure 9:
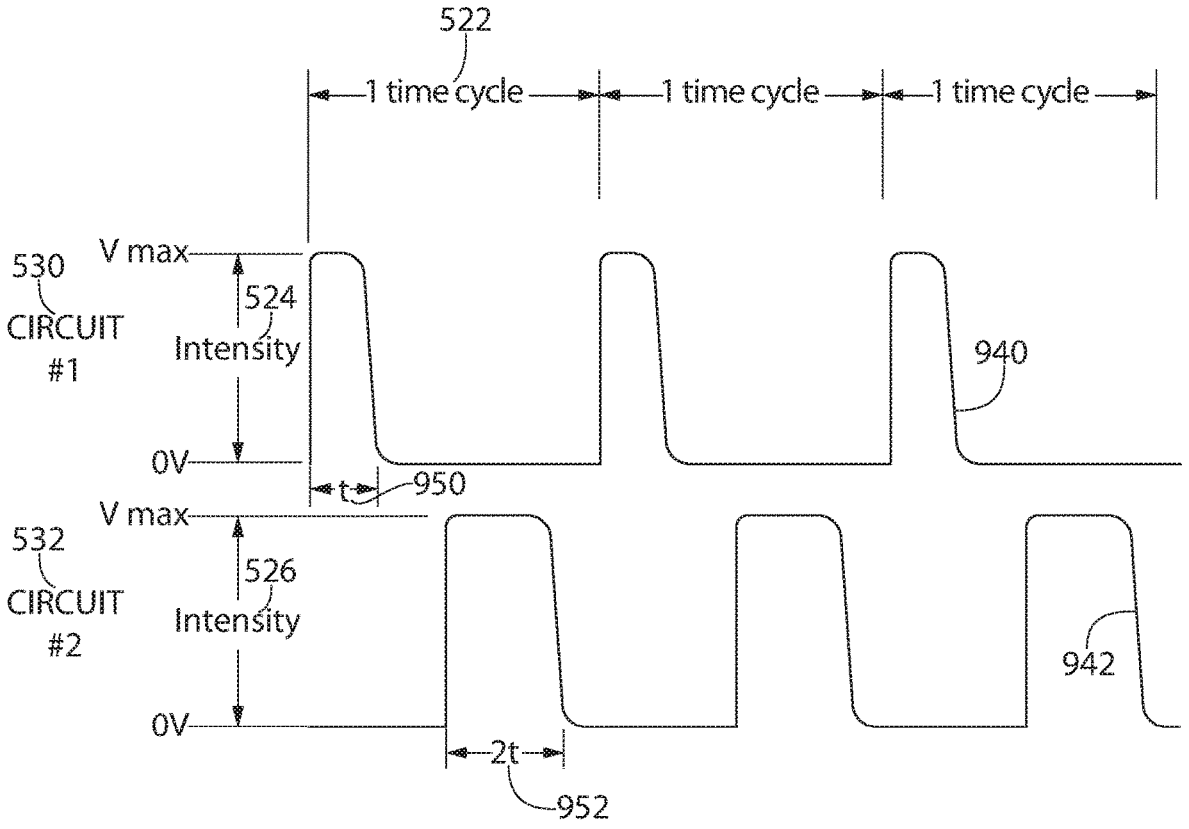
Figure 10:
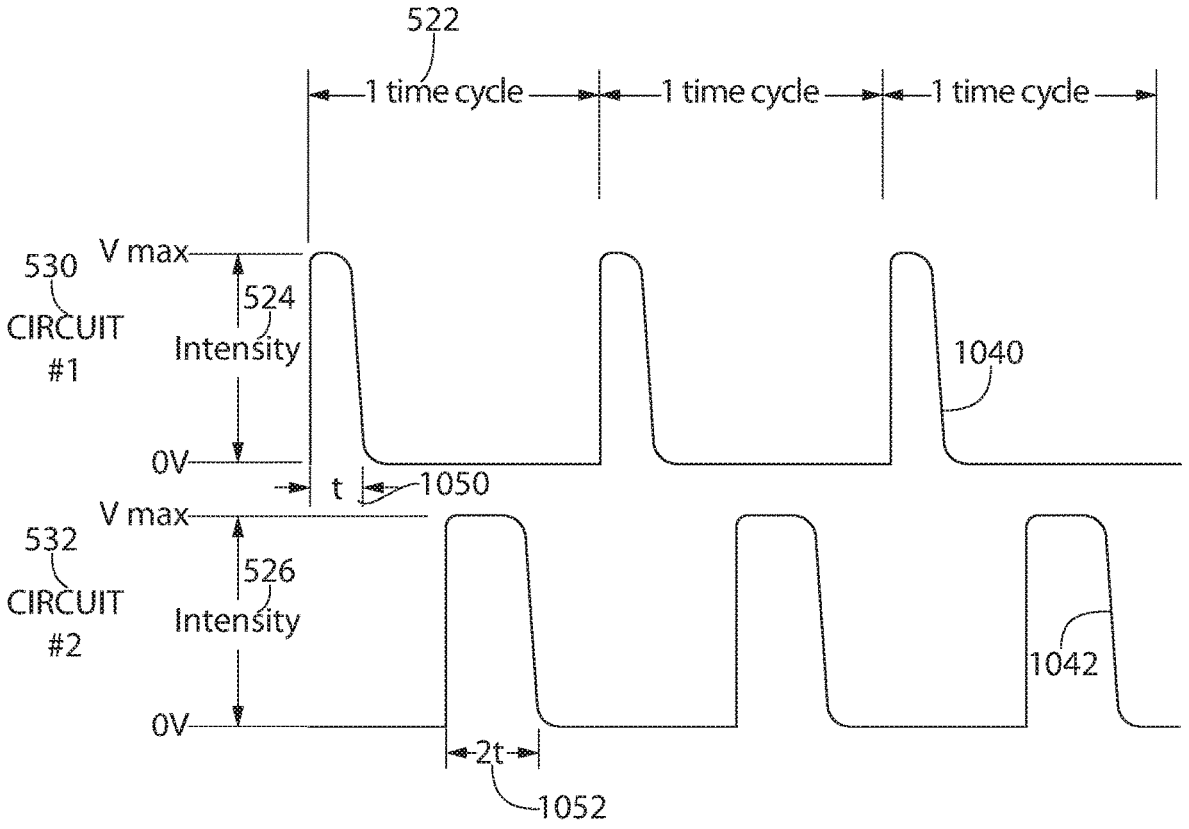

FIG. 9 and FIG. 10 are examples showing an intensity being adjusted (e.g., decreased) via a ratio. The decreased intensity is shown in FIGS. 9 and 10 via a decrease of the pulse lengths of the waveforms. However, intensity may be adjusted (e.g., decreased or increased) via other methods, as described herein and understood by those of skill in the art.

As shown in FIG. 9, waveform 940 may have a pulse length 950 of time 't' and waveform 942 may have a pulse length 952 of time '2t,' indicating that the pulse length of 952 is twice a long as pulse length 950. Although FIG. 9 shows a pulse length that is one half of another pulse length, other multiples may be used, such as one thirds, one quarters, etc. As pulse length 950 is one half of pulse length 952, the LED associated with waveform 940 may emit a light and/or color that is less intense (e.g., one-half less intense) than the LED associated with waveform 942, which has a pulse length 952. As seen in FIGS. 9 and 10, the pulse lengths from FIG. 9 to FIG. 10 may decrease. In an example, the pulse lengths from both of the waveforms 940, 942 shown in FIG. 9 may be modified (e.g., decrease) in relationship to FIG. 10. For example, the pulse lengths from both of the waveforms 940, 942 may be modified (e.g., may decrease) to the pulse lengths of waveforms 1040, 1042. The pulse lengths from both of the waveforms 940, 942 may be modified (e.g., may decrease) according to a same ratio (such as decreasing by one half).

For example, the pulse length 1050 of waveform 1040 may be one half of the pulse length 950 of waveform 940. Similarly, the pulse length 1052 of waveform 1042 may be one half of the pulse length 952 of waveform 942. Thus, the pulse lengths from waveforms shown in FIG. 9 have decreased according to a same ratio with respect to the waveforms shown in FIG. 10. As the ratio of the pulse lengths have decreased according to a same ratio (e.g., one half), the intensities have been modified based on the same ratio. Because the intensities of the ratios have been modified based on the same ratio, the intensities and/or color temperatures (e.g., composite color temperature) may be maintained from FIG. 9 to FIG. 10.

Figure 11:
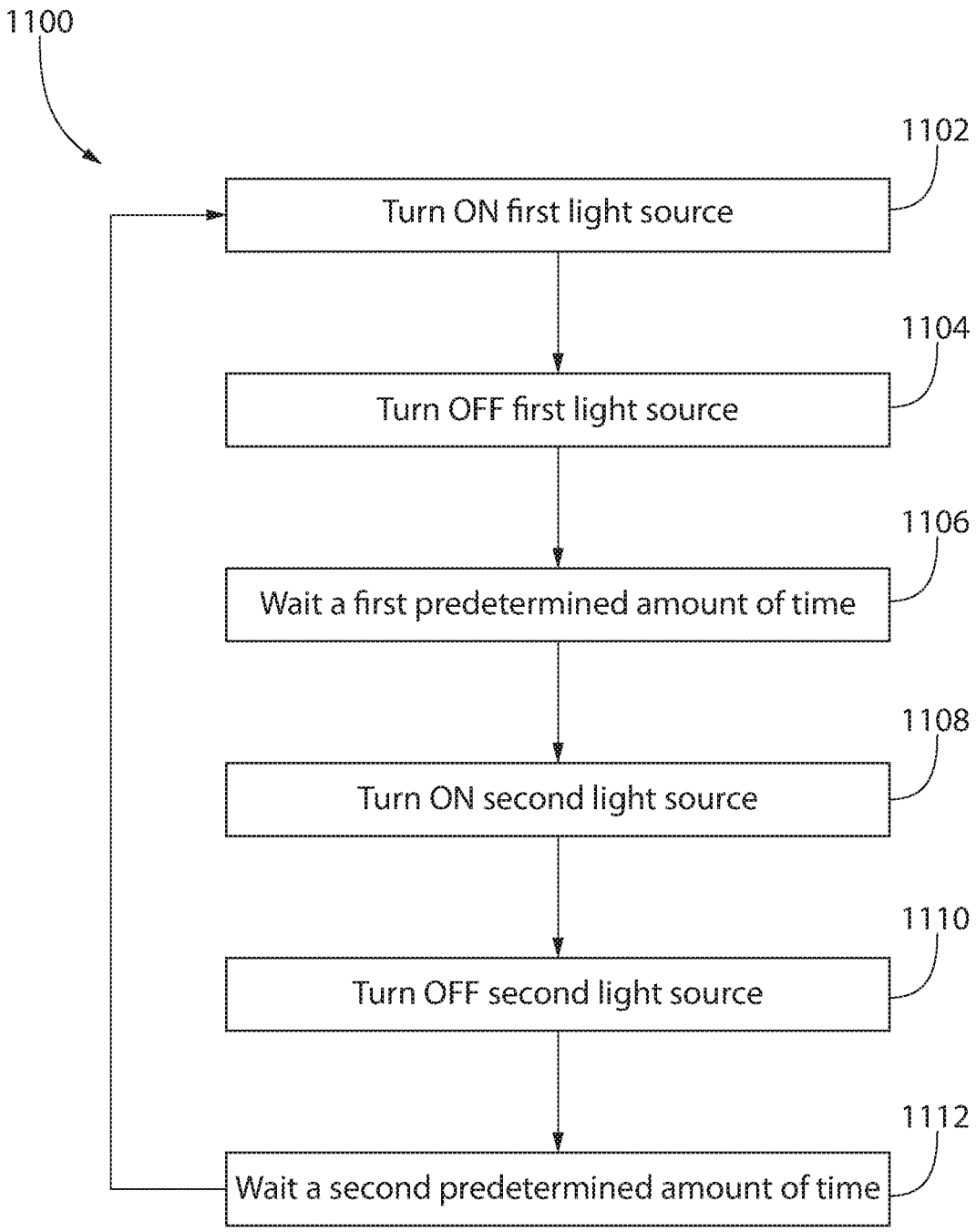
FIG. 11 is an example process for combining color temperatures, as described herein.

FIG. 11 shows an example process 1100 for combining color temperatures. Power may be provided to one or more light sources, such as one or more LEDs. Each of the light sources may be configured to emit an electromagnetic radiation when powered ON. Each of the electromagnetic radiations emitted by the light sources may be different than one or more of the electromagnetic radiations emitted by one or more of the other light sources. Each of the electromagnetic radiation emissions may have a color temperature that may be different than color temperatures of one or more of the other light sources.

At 1102, a first light source may be turned ON. The first light source may be turned ON, for example, by being provided a voltage via voltage source. A controller, such as controller 306, 406, may be configured to turn ON the first light source. The controller may turn ON the first light source based on a control signal, such as control signal 308, 408. Light sources may alternative from an ON state to an OFF state. For example, at 1104 the first light source may be turned OFF. The first light source may be turned OFF, for example, by removing a voltage provided to the first light source via voltage source. A controller, such as controller 306, 406, may be configured to turn OFF the first light source. The controller may turn OFF the first light source based on a control signal, such as control signal 308, 408.

At 1106, a first predetermined amount of time may be waited between turning OFF the first light source and turning ON a second light source. The first predetermined amount of time may ensure that one (e.g., only one) of the light sources is ON at a time.

At 1108, a second light source (e.g., LED) may be turned ON. The second light source may be turned ON, for example, by being provided a voltage via voltage source. A controller, such as controller 306, 406, may be configured to turn ON the second light source. The controller may turn ON the second light source based on a control signal, such as control signal 308, 408. At 1110, the second light source may be turned OFF. The second light source may be turned OFF, for example, by removing a voltage provided to the second light source via voltage source. A controller, such as controller 306, 406, may be configured to turn OFF the second light source. The controller may turn OFF the second light source based on a control signal, such as control signal 308, 408.

At 1112, a second predetermined amount of time may be waited between turning OFF the second light source and turning ON the first light source. The second predetermined amount of time may be the same as the first predetermined amount of time or different than the first predetermined amount of time. The second predetermined amount of time may ensure that one (e.g., only one) of the light sources is ON at a time. The process may begin again at 1102.

Although FIG. 11 describes a first and second light source, the use of two light sources is for illustration purposes only and the process is not so limited. For example, three, or more, light sources may be used to combine color temperatures, as described herein. Light source (e.g., first light source, second light source, etc.) may be turned ON and turned OFF such that the electromagnetic radiation of each light source includes a series of pulses. The light sources (e.g., first light source, second light source, etc.) may be turned ON with a speed sufficient to cause a perception of mixing the electromagnetic radiations of the light sources. The perception of mixing of the electromagnetic radiations may cause an appearance of a perceived light having a perceived color temperature different from the color temperatures of the light sources.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A lighting apparatus comprising:

a plurality of light sources, each light source of the plurality of light sources configured to emit a different electromagnetic radiation having a different color temperature when turned ON;

a voltage source providing power to the plurality of light sources;

a controller configured to:

turn ON and OFF each light source of the plurality of light sources such that each electromagnetic radiation of each light source comprises a series of pulses; and alternate between turning ON each of the plurality of light sources with a speed sufficient to cause a perception of mixing the electromagnetic radiations of the plurality of light sources, and thereby cause an appearance of a perceived light having a perceived color temperature different from the color temperatures of the plurality of light sources;

wherein to ensure that only one of the plurality of light sources is ON at a time, the controller waits a predetermined time between turning OFF a light source and turning ON a subsequent light source;

wherein the predetermined time is based on both (a) a time for a light source of the plurality of light sources to turn OFF and (b) a variable buffer time that is distinct from the time for the light source to turn OFF; and wherein the variable buffer time varies based on conditions external to the lighting apparatus that affect the perception of mixing of the electromagnetic radiations.

2. The lighting apparatus of claim 1 wherein each of the plurality of light sources comprises light-emitting diodes (LEDs) emitting a shared electromagnetic radiation having a shared color temperature when turned ON.

3. The lighting apparatus of claim 1 wherein the controller alters the perceived color temperature by altering a length of at least one of the series of pulses.

4. The lighting apparatus of claim 3 wherein the controller alters the perceived color temperature by also altering a voltage level of at least one of the series of pulses.

5. The lighting apparatus of claim 1 wherein the controller alters a perceived brightness of the perceived light by altering a length of at least one of the series of pulses.

6. The lighting apparatus of claim 5 wherein the perceived color temperature is maintained while the perceived brightness is altered by maintaining a ratio between the lengths of each of the series of pulses when the length of the at least one of the series of pulses is altered.

7. The lighting apparatus of claim 1 wherein the controller alters a perceived color temperature and a perceived brightness of the perceived light by altering a length of at least one of the series of pulses.

8. The lighting apparatus of claim 1 wherein:

the controller alters a perceived brightness of the perceived light by altering a pulse length and a voltage level of at least one of the series of pulses; and the perceived color temperature is maintained while the perceived brightness is altered by maintaining a ratio between the lengths of each of the series of pulses and a ratio between the voltage levels of each of the series of pulses.

9. The lighting apparatus of claim 1 wherein the controller alters a perceived color and a perceived brightness of the perceived light by altering a pulse length and a voltage level of at least one of the series of pulses.

10. The lighting apparatus of claim 1 wherein the controller alters the perceived color temperature by altering a voltage level of at least one of the series of pulses.

11. The lighting apparatus of claim 1 wherein the controller alters a perceived brightness of the perceived light by altering a voltage level of at least one of the series of pulses.

12. The lighting apparatus of claim 11 wherein the perceived color temperature is maintained while the perceived brightness is altered by maintaining a ratio between the voltage levels of each of the series of pulses when the voltage level of the at least one of the series of pulses is altered.

13. The lighting apparatus of claim 1 wherein the controller alters a perceived color temperature and a perceived brightness of the perceived light by altering a voltage level of at least one of the series of pulses.

14. A method comprising:

providing power to a plurality of light sources, each light source of the plurality of light sources configured to emit a different electromagnetic radiation having a different color temperature when turned ON; and alternating between turning ON each of the plurality of light sources with a speed sufficient to cause a perception of mixing the electromagnetic radiations of the plurality of light sources, and thereby cause an appearance of a perceived light having a perceived color temperature different from the color temperatures of the plurality of light sources;

wherein each light source of the plurality of light sources is turned ON and OFF such that each electromagnetic radiation of each light source comprises a series of pulses; and wherein, to ensure that only one of the plurality of light sources is ON at a time, a predetermined time is waited between turning OFF a light source and turning ON a subsequent light source;

wherein the predetermined time is based on both (a) a time for a light source of the plurality of light sources to turn OFF and (b) a variable buffer time that is distinct from the time for the light source to turn OFF; and wherein the variable buffer time varies based on conditions external to the lighting apparatus that affect the perception of mixing of the electromagnetic radiations.

15. The method of claim 14 wherein the controller alters the perceived color temperature by altering a length of at least one of the series of pulses.

16. The method of claim 14 wherein the controller alters a perceived brightness of the perceived light by altering a length of at least one of the series of pulses.

17. A non-transitory computer-readable storage medium encoded with instructions which, when executed on a processor, perform a method of:

turning ON and OFF a plurality of light sources, each light source the plurality of light sources configured to emit a different electromagnetic radiation having a different color temperature when turned ON, and each electromagnetic radiation of each light source comprising a series of pulses; and alternating between turning ON each of the plurality of light sources with a speed sufficient to cause a perception of mixing the electromagnetic radiations of the plurality of light sources, and thereby cause an appearance of a perceived light having a perceived color temperature different from the color temperatures of the plurality of light sources;

wherein, to ensure that only one of the plurality of light sources is ON at a time, a predetermined time is waited between turning OFF a light source and turning ON a subsequent light source;

wherein the predetermined time is based on both (a) a time for a light source of the plurality of light sources to turn OFF and (b) a variable buffer time that is distinct from the time for the light source to turn OFF; and wherein the variable buffer time varies based on conditions external to the lighting apparatus that affect the perception of mixing of the electromagnetic radiations.

* * * * *